US011287767B2

(12) United States Patent
Matsuda

(10) Patent No.: US 11,287,767 B2
(45) Date of Patent: Mar. 29, 2022

(54) FIXING DEVICE AND IMAGE FORMING APPARATUS INCORPORATING SAME

(71) Applicant: Ricoh Company, Ltd., Tokyo (JP)

(72) Inventor: Ryohei Matsuda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/923,246

(22) Filed: Jul. 8, 2020

(65) Prior Publication Data

US 2021/0041818 A1 Feb. 11, 2021

(30) Foreign Application Priority Data

Aug. 9, 2019 (JP) ..... JP2019-147233

(51) Int. Cl.
*G03G 15/20* (2006.01)

(52) U.S. Cl.
CPC ..... *G03G 15/2053* (2013.01); *G03G 15/2042* (2013.01); *G03G 15/2064* (2013.01); *G03G 2215/2038* (2013.01)

(58) Field of Classification Search
CPC ..... G03G 15/2064; G03G 15/2053; G03G 15/2042; G03G 15/2017; H05B 3/06
See application file for complete search history.

(56) References Cited

U.S. PATENT DOCUMENTS 4,186,369 A * 1/1980 Attridge ..... H01C 1/02 219/541
5,404,214 A * 4/1995 Yoshimoto ..... G03G 15/2064 219/216
6,157,805 A * 12/2000 Haneda ..... G03G 15/2053 399/328
6,442,360 B1 * 8/2002 Onodera ..... G03G 15/2053 219/216
6,712,629 B1 * 3/2004 Alexander ..... H01R 33/02 439/240
9,291,984 B2 * 3/2016 Moriya ..... G03G 15/2017
9,529,309 B2 * 12/2016 Ishii ..... G03G 15/2053
9,541,872 B2 * 1/2017 Takahashi ..... G03G 15/2053
2008/0205949 A1 * 8/2008 Ito ..... G03G 15/2053 399/330
2015/0098738 A1 * 4/2015 Arai ..... G03G 15/2053 399/329
2016/0246228 A1 8/2016 Fujimoto et al.
2016/0327900 A1 * 11/2016 Tanaka ..... G03G 21/1647
2017/0248879 A1 8/2017 Ishigaya et al.
2018/0348680 A1 12/2018 Fujimoto et al.
2019/0094764 A1 3/2019 Ishigaya et al.

FOREIGN PATENT DOCUMENTS

JP 4-070688 3/1992
JP 2001-356623 12/2001
JP 2015-075525 4/2015
JP 2016-156858 9/2016
JP 2016-200665 12/2016

* cited by examiner

*Primary Examiner* — Arlene Heredia
(74) *Attorney, Agent, or Firm* — Xsensus LLP

(57) ABSTRACT

A fixing device includes an endless first rotator, a second rotator configured to contact and press the first rotator, a heater configured to heat the first rotator, a heater support, and a thermal equalizer contacting the first rotator to uniform a temperature distribution in an axial direction of the first rotator. The heater support supports the heater by a clearance fit.

8 Claims, 4 Drawing Sheets

FIXING DEVICE AND IMAGE FORMING APPARATUS INCORPORATING SAME

CROSS-REFERENCE TO RELATED APPLICATION

This patent application is based on and claims priority pursuant to 35 U.S.C. § 119 to Japanese Patent Application No. 2019-147233, filed on Aug. 9, 2019 in the Japan Patent Office, the entire disclosure of which is hereby incorporated by reference herein.

BACKGROUND

Technical Field

Embodiments of the present disclosure generally relate to a fixing device and an image forming apparatus incorporating the fixing device.

Background Art

One type of fixing device in an image forming apparatus includes an endless first rotator, a second rotator to contact and press the first rotator, a heater to heat the first rotator, and a heater support to support the heater.

SUMMARY

This specification describes an improved fixing device that includes an endless first rotator, a second rotator configured to contact and press the first rotator, a heater configured to heat the first rotator, a heater support, and a thermal equalizer contacting the first rotator to uniform a temperature distribution in an axial direction of the first rotator. The heater support supports the heater by a clearance fit.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
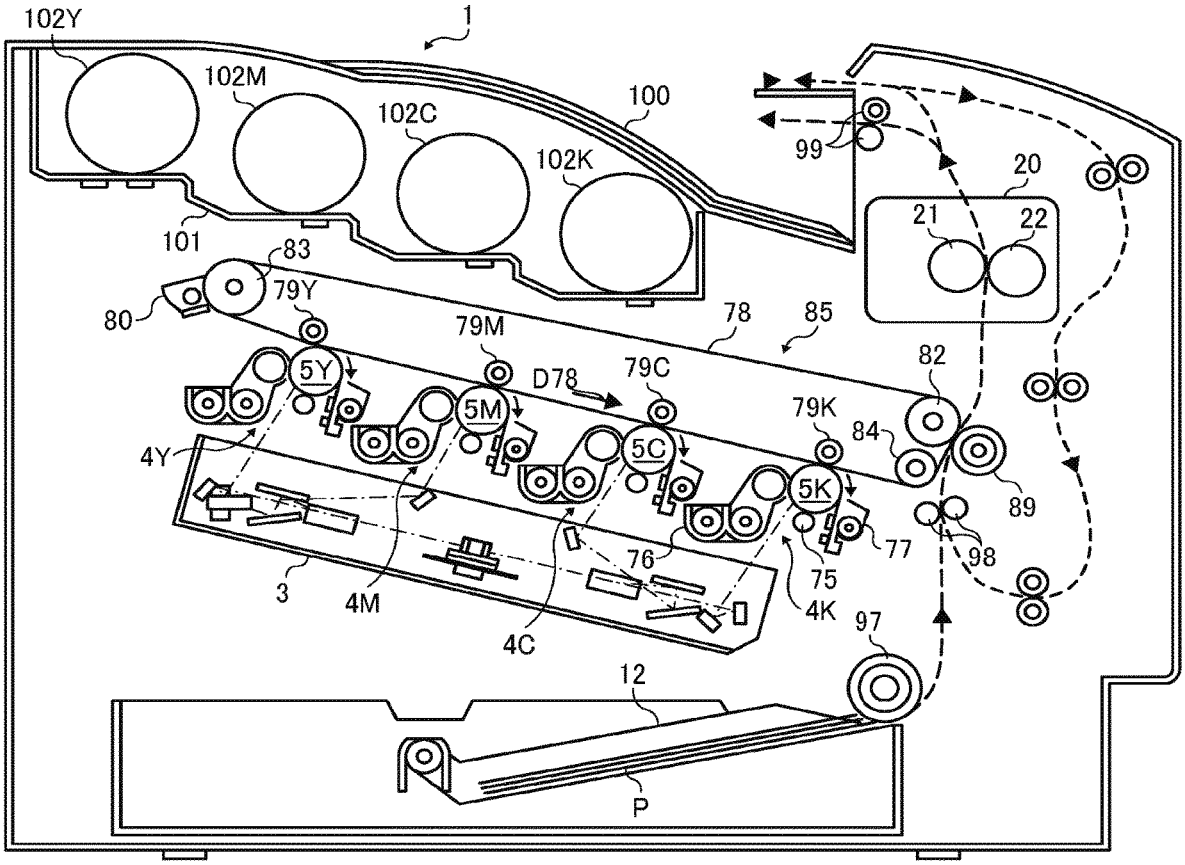
FIG. 1 is a schematic view illustrating a configuration of an image forming apparatus according to a present embodiment.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

As an image forming apparatus including a fixing device according to an embodiment of the present disclosure, a color electrophotographic image forming apparatus (hereinafter, referred to as an image forming apparatus 1) is described below.

FIG. 1 is a schematic view illustrating a configuration of the image forming apparatus 1 according to the present embodiment.

As illustrated in FIG. 1, the image forming apparatus 1 according to the present embodiment is a tandem-type color printer.

A bottle container 101 is disposed in an upper portion of a main body of the image forming apparatus 1. The bottle container 101 includes four toner bottles 102Y, 102M, 102C, and 102K, which are removable from the bottle container 101, and therefore replaceable. The toner bottles 102Y, 102M, 102C, and 102K contain toner of yellow, magenta, cyan, and black, respectively. It is to be noted that, in the following description, suffixes Y, M, C, and K denote colors of yellow, magenta, cyan, and black, respectively. To simplify the description, these suffixes are omitted unless necessary.

Under the bottle container 101, an intermediate transfer unit 85 is disposed. Facing an intermediate transfer belt 78 of the intermediate transfer unit 85, image forming devices 4Y, 4M, 4C, and 4K are arranged side by side to form toner images of yellow, magenta, cyan, and black, respectively. The image forming devices 4Y, 4M, 4C, and 4K include photoconductor drums 5Y, 5M, 5C, and 5K, respectively. Each of the photoconductor drums 5Y, 5M, 5C, and 5K is surrounded by a charger 75, a developing device 76, a cleaner 77, a discharger, and the like. On each of the photoconductor drums 5Y, 5M, 5C, and 5K, image forming processes including a charging process, an exposure process, a developing process, a primary transfer process, and a cleaning process are performed, forming yellow, magenta, cyan, and black toner images on the photoconductor drums 5Y, 5M, 5C, and 5K, respectively.

A drive motor drives and rotates the photoconductor drums 5Y, 5M, 5C, and 5K clockwise in FIG. 1. The charger 75 disposed opposite each of the photoconductor drums 5Y, 5M, 5C, and 5K uniformly charges the outer circumferential surface thereof in the charging process. After the charging process, the charged outer circumferential surface of each of the photoconductor drums 5Y, 5M, 5C, and 5K reaches an irradiation position at which an exposure device 3 irradiates and scans the photoconductor drums 5Y, 5M, 5C, and 5K with laser beams L, irradiating and scanning the photoconductor drums 5Y, 5M, 5C, and 5K with the laser beams L forms electrostatic latent images according to yellow, magenta, cyan, and black image data in the exposure process. After the exposure process, the irradiated and scanned outer circumferential surface of each of the photoconductor drums 5Y, 5M, 5C, and 5K reaches a developing position at which the developing device 76 is disposed opposite each of the photoconductor drums 5Y, 5M, 5C, and 5K, and the developing device 76 develops the electrostatic latent image formed on the respective photoconductor drums 5Y, 5M, 5C, and 5K, thus forming yellow, magenta, cyan, and black toner images on the photoconductor drums 5Y, 5M, 5C, and 5K in the developing process. After the developing process, the yellow, magenta, cyan, and black toner images formed on the photoconductor drums 5Y, 5M, 5C, and 5K reach primary transfer nips formed between the photoconductor drums 5Y, 5M, 5C, and 5K and the intermediate transfer belt 78 by four primary transfer bias rollers 79Y, 79M, 79C, and 79K pressed against the four photoconductor drums 5Y, 5M, 5C, and 5K via the intermediate transfer belt 78, respectively, and the yellow, magenta, cyan, and black toner images formed on the photoconductor drums 5Y, 5M, 5C, and 5K, respectively, are primarily transferred onto the intermediate transfer belt 78 in a primary transfer process. After the primary transfer process, residual toner failed to be transferred onto the intermediate transfer belt 78 remains on the photoconductor drums 5Y, 5M, 5C, and 5K slightly. After the primary transfer process, the residual toner on each of the photoconductor drums 5Y, 5M, 5C, and 5K reaches a cleaning position at which the cleaner 77 is disposed opposite each of the photoconductor drums 5Y, 5M, 5C, and 5K, and a cleaning blade of the cleaner 77 mechanically collects the residual toner from each of the photoconductor drums 5Y, 5M, 5C, and 5K in the cleaning process. Finally, the cleaned outer circumferential surface of each of the photoconductor drums 5Y, 5M, 5C, and 5K reaches a discharging position at which the discharger is disposed opposite each of the photoconductor drums 5Y, 5M, 5C, and 5K, and the discharger eliminates residual potential from each of the photoconductor drums 5Y, 5M, 5C, and 5K.

Thus, a series of image forming processes performed on the photoconductor drums 5Y, 5M, 5C, and 5K is finished. The toner images formed on the photoconductor drums 5Y, 5M, 5C, and 5K through the developing process are transferred therefrom and superimposed on the intermediate transfer belt 78. Thus, a multicolor toner image is formed on the intermediate transfer belt 78.

The intermediate transfer unit 85 includes the intermediate transfer belt 78, the four primary transfer bias rollers 79Y, 79M, 79C, and 79K, a secondary transfer backup roller 82, a cleaning backup roller 83, a tension roller 84, and an intermediate transfer belt cleaner 80.

The intermediate transfer belt 78 is stretched taut across and supported by the three rollers, that is, the secondary transfer backup roller 82, the cleaning backup roller 83, and the tension roller 84. One of the three rollers, that is, the secondary transfer backup roller 82 drives and rotates the intermediate transfer belt 78 in a rotation direction indicated by arrow D78 in FIG. 1. The four primary transfer bias rollers 79Y, 79M, 79C, and 79K sandwich the intermediate transfer belt 78 together with the four photoconductor drums 5Y, 5M, 5C, and 5K, respectively, thus forming the four primary transfer nips between the intermediate transfer belt 78 and the photoconductor drums 5Y, 5M, 5C, and 5K.

The primary transfer bias rollers 79Y, 79M, 79C, and 79K are applied with a primary transfer bias having a polarity opposite a polarity of electric charge of toner. The intermediate transfer belt 78 is moved in the direction indicated by arrow D78 and sequentially passes through the primary transfer nips formed by the primary transfer bias rollers 79Y, 79M, 79C, and 79K. The yellow, magenta, cyan, and black toner images on the photoconductor drums 5Y, 5M, 5C, and 5K are primarily transferred to and superimposed on the intermediate transfer belt 78, thereby forming a multicolor toner image. Subsequently, the intermediate transfer belt 78 carrying the yellow, magenta, cyan, and black toner images reaches a position opposite the secondary transfer roller 89. At the position, the secondary transfer backup roller 82 and the secondary transfer roller 89 press against each other via the intermediate transfer belt 78, and the contact portion therebetween is hereinafter referred to as a secondary transfer nip.

The yellow, magenta, cyan, and black toner images superimposed on the intermediate transfer belt 78 are secondarily transferred onto a recording medium P conveyed through the secondary transfer nip in a secondary transfer process. After the secondary transfer process, residual toner failed to be transferred on the recording medium P remains on the intermediate transfer belt 78. The intermediate transfer belt 78 reaches a position opposite the intermediate transfer belt cleaner 80. At the position, the intermediate transfer belt cleaner 80 collects the residual toner from the intermediate transfer belt 78. Thus, a sequence of image forming processes performed on the intermediate transfer belt 78 is completed. The recording medium P is conveyed from a sheet feeder 12 disposed in a lower portion of the image forming apparatus 1 to the secondary transfer nip via a sheet feeding roller 97, a registration roller pair 98, and the like.

The sheet feeder 12 contains multiple recording media P such as sheets piled one on another. As the sheet feeding roller 97 rotates counterclockwise in FIG. 1, the sheet feeding roller 27 feeds an uppermost recording medium P in the sheet feeder 12 to a roller nip between the registration roller pair 98. The registration roller pair 98 stops rotating temporarily, stopping the recording medium P with a leading edge of the recording medium P nipped in the roller nip between the registration roller pair 98. Then, the registration roller pair 98 rotates to convey the recording medium P to the secondary transfer nip, timed to coincide with the arrival of the multicolor toner image on the intermediate transfer belt 78. As the recording medium P is conveyed through the secondary transfer nip, the color toner image formed on the intermediate transfer belt 78 is secondarily transferred onto the recording medium P. In the above, the image forming devices 4Y, 4M, 4C, and 4K, the intermediate transfer unit 85, and the secondary transfer roller 89 function as an image forming section that forms an image on the recording medium P. However, the image forming section is not limited to the above-described configuration. For example, the image forming section may be configured by one photoconductor, image forming components that surround the photoconductor, and one transfer device. Thereafter, the recording medium P transferred with the color toner image at the secondary transfer nip is conveyed to a fixing device 20.

In the fixing device 20, a fixing belt 21 and a pressure roller 22 apply heat and pressure to the recording medium P to fix the transferred color toner image on the recording medium P. Thereafter, the recording medium P bearing the fixed toner image is conveyed through a roller nip formed by an output roller pair 99 and ejected by the output roller pair 99 onto an outside of the image forming apparatus 1. The recording media P ejected by the output roller pair 99 onto the outside of the image forming apparatus 1 are sequentially stacked as output images on a stack section 100. Thus, a series of image forming processes performed by the image forming apparatus 1 is completed.

Figure 2:
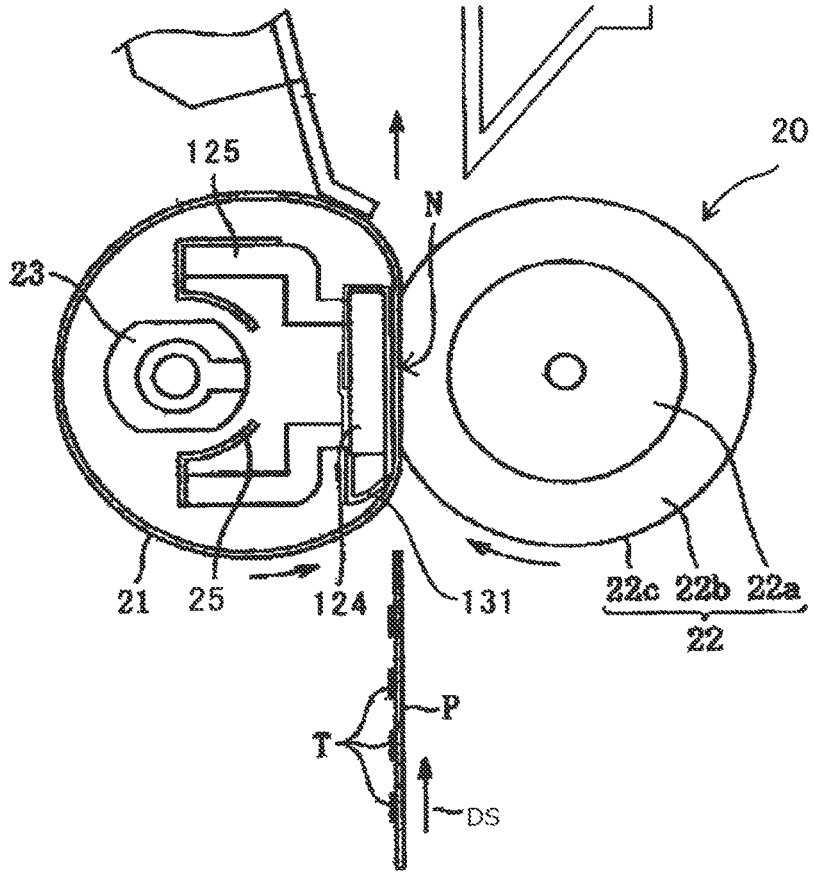
FIG. 2 is a schematic view illustrating a configuration of a fixing device in FIG. 1.

FIG. 2 is a schematic view illustrating a configuration of the fixing device 20.

The fixing device 20 in the present embodiment includes the fixing belt 21 as a fixing member that is a rotatable first rotator and the pressure roller 22 as a pressing member that is a rotatable second rotator facing the first rotator. Radiant heat from a halogen heater 23 as a heat source directly heats the inner circumferential surface of the fixing belt 21.

Inside a loop of the fixing belt 21, the fixing device 20 illustrated in FIG. 2 includes a nip formation pad 124 that presses against the pressure roller 22 via the fixing belt 21 to form the fixing nip N between the fixing belt 21 and the pressure roller 22. As the fixing belt 21 rotates, the inner circumferential surface of the fixing belt 21 slides over the nip formation pad 124 indirectly via a thermal equalizer 131. As the recording medium P bearing the toner image T is conveyed through the fixing nip N in a sheet conveyance direction, the fixing belt 21 and the pressure roller 22 fix the toner image on the recording medium P under heat and pressure.

Although FIG. 2 illustrates the thermal equalizer 131 having a flat surface to form the fixing nip N, the thermal equalizer 131 may be contoured into a recess or other shapes. If the thermal equalizer 131 contours the fixing nip N into the recess, the recessed fixing nip N directs the leading edge of the recording medium P toward the pressure roller 22 as the recording medium P is ejected from the fixing nip N, facilitating separation of the recording medium P from the fixing belt 21 and preventing jamming of the recording medium P.

Inside the loop of the fixing belt 21, the fixing device 20 includes a stay 125 that supports the nip formation pad 124 against pressure from the pressure roller 22 in addition to the above-described nip formation pad 124 facing the pressure roller 22, the thermal equalizer 131 covering the surface of the nip formation pad 124 facing the inner surface of the fixing belt 21, and the halogen heater 23 to heat the fixing belt 21.

Each of the nip formation pad 124, the thermal equalizer 131, and the stay 125 extends in an axial direction of the fixing belt 21 (hereinafter referred to as a longitudinal direction) and has a certain length in the longitudinal direction.

The thermal equalizer 131 facilitates conduction of heat in the longitudinal direction and reduces uneven temperature of the fixing belt 21 in the longitudinal direction. Therefore, preferably, the thermal equalizer 131 is made of a material that conducts heat quickly, for example, a material having an increased thermal conductivity such as copper, aluminum, and silver.

In the present embodiment, the thermal equalizer 131 has a nip formation surface disposed opposite the inner circumferential surface of the fixing belt 21 and in direct contact with the inner circumferential surface of the fixing belt 21.

The fixing belt 21 is an endless belt or film made of metal such as nickel or stainless steel (steel use stainless, that is, SUS), or resin such as polyimide. The fixing belt 21 includes a base layer and a release layer. The release layer constitutes an outer surface layer and is made of perfluoroalkoxy alkane (PFA), polytetrafluoroethylene (PTFE), or the like to facilitate separation of toner of the toner image on the recording medium P from the fixing belt 21, thus preventing the toner of the toner image from adhering to the fixing belt 21. An elastic layer may be sandwiched between the base layer and the release layer and made of silicone rubber or the like. The fixing belt 21 that does not incorporate the elastic layer made of silicone rubber has a small thermal capacity that improves fixing property of being heated quickly to a desired fixing temperature at which the toner image is fixed on the recording medium P. However, as the fixing belt 21 presses the unfixed toner image on the recording medium P, slight surface asperities in the fixing belt 21 are transferred onto the toner image on the recording medium P, resulting in variation in gloss of the solid toner image that may appear as an orange peel image on the recording medium P. To address this circumstance, the elastic layer made of silicone rubber has a thickness not smaller than about 100 micrometers. Deformation of the elastic layer made of silicone rubber absorbs the slight surface asperities in the fixing belt 21, preventing formation of the faulty orange peel image.

In the present embodiment, the halogen heater 23 is supported by a clearance fit as described below, and the distance between the fixing belt 21 and the halogen heater 23 tends to vary in the axial direction. As a result, the amount of heat applied from the halogen heater 23 to the fixing belt 21 becomes non-uniform in the axial direction, and the temperature distribution of the fixing belt 21 may become non-uniform in the axial direction. Therefore, the fixing belt 21 of the present embodiment is preferably made of metal having a high thermal conductivity, more preferably made of material having a higher thermal conductivity than the material of the thermal equalizer 131. The fixing belt 21 made of the material having the high thermal conductivity as described above easily transfers heat in the axial direction of the fixing belt 21 and can prevent the temperature distribution of the fixing belt 21 in the axial direction thereof from becoming non-uniform.

The stay 125 supports the nip formation pad 124 against pressure from the pressure roller 22 to prevent bending of the nip formation pad 124 and produce the even length of the fixing nip N in the recording medium conveyance direction DS throughout the entire width of the fixing belt 21 in the axial direction thereof. Both ends of the stay 125 are held and fixed to the side plates 201 of the fixing device 20 and positioned (see FIG. 4). Between the stay 125 and the halogen heater 23, a reflector 25 is disposed to prevent the stay 125 from being heated by the radiant heat from the halogen heaters 23 and reduce wasteful energy consumption. Alternatively, instead of the reflector 25, an opposed face of the stay 125 disposed opposite the halogen heater 23 may be treated with insulation or mirror finish to obtain similar effects.

The pressure roller 22 includes a cored bar 22*a*, an elastic rubber layer 22*b* coating the cored bar 22*a*, and a surface release layer 22*c* coating the elastic rubber layer 22*b* and made of PFA or PTFE to facilitate separation of the recording medium P from the pressure roller 22. A driving force is transmitted to the pressure roller 22 through gears from a drive source, such as a motor, provided in the image forming apparatus 1, to rotate the pressure roller 22. A spring or the like presses the pressure roller 22 against the nip formation pad 124 via the fixing belt 21. As the spring presses and deforms the elastic rubber layer 22*b* of the pressure roller 22, the pressure roller 22 produces the fixing nip N having the predetermined length in the sheet conveyance direction DS.

The pressure roller 22 may be a hollow roller. Alternatively, the pressure roller 22 may include a heating source such as a halogen heater.

The elastic rubber layer 22*b* may be made of solid rubber. Alternatively, if no heater is situated inside the pressure roller 22, the elastic rubber layer 22*b* may be made of sponge rubber. The sponge rubber is preferable to the solid rubber because the sponge rubber has enhanced thermal insulation and so draws less heat from the fixing belt 21.

The fixing belt 21 rotates in accordance with rotation of the pressure roller 22. In the example of FIG. 2, as a driver drives and rotates the pressure roller 22, a driving force of the driver is transmitted from the pressure roller 22 to the fixing belt 21 through the fixing nip N, thus rotating the fixing belt 21 by friction between the pressure roller 22 and the fixing belt 21. At the fixing nip N, the fixing belt 21 rotates as the fixing belt 21 is sandwiched between the pressure roller 22 and the nip formation pad 124; at a circumferential span of the fixing belt 21 other than the fixing nip N, the fixing belt 21 rotates while the fixing belt 21 is guided by the flange at each lateral end of the fixing belt 21 in the axial direction thereof.

With the construction described above, the fixing device 20 attaining quick warm-up is manufactured at reduced costs.

Figure 3:
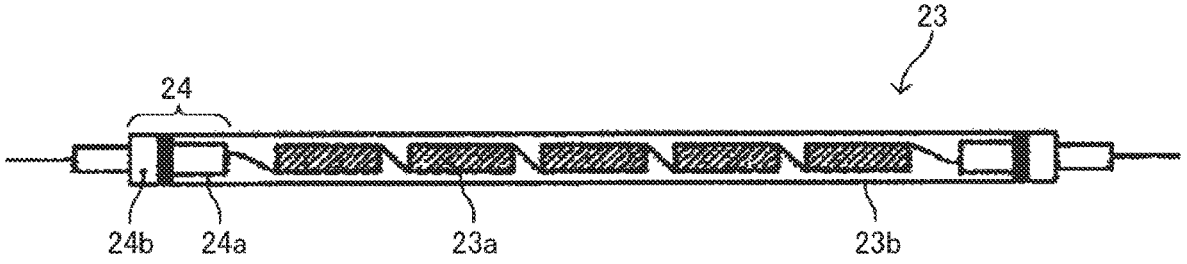
FIG. 3 is a schematic view illustrating a configuration of a halogen heater.

FIG. 3 is a schematic view illustrating a configuration of the halogen heater 23.

The halogen heater 23 includes a filament light emitter 23*a*; a glass tube 23*b* accommodating the filament light emitter 23*a* and containing filler gas; and sealings 24 disposed at both ends of the glass tube 23*b* to seal the glass tube 23*b*. The sealings 24 seal the filler gas in the glass tube 23*b*. The filament light emitter 23*a* serving as a heat generator includes a tungsten wire coiled at a predetermined interval. The number of coiling of the tungsten wire, the interval of coiling, and the like define the light emission intensity. The filler gas is produced by mixing a slight amount of a halogen substance such as iodine and bromine with inert gas such as nitrogen. The filler gas reduces thermal vaporization of the tungsten wire, extending the life of the tungsten wire.

The sealing 24 includes a molybdenum foil 24*a* that is electrically coupled to non-light-emitting part of a filament and a cement 24*b* that seals the glass tube 23*b*.

Figure 4:
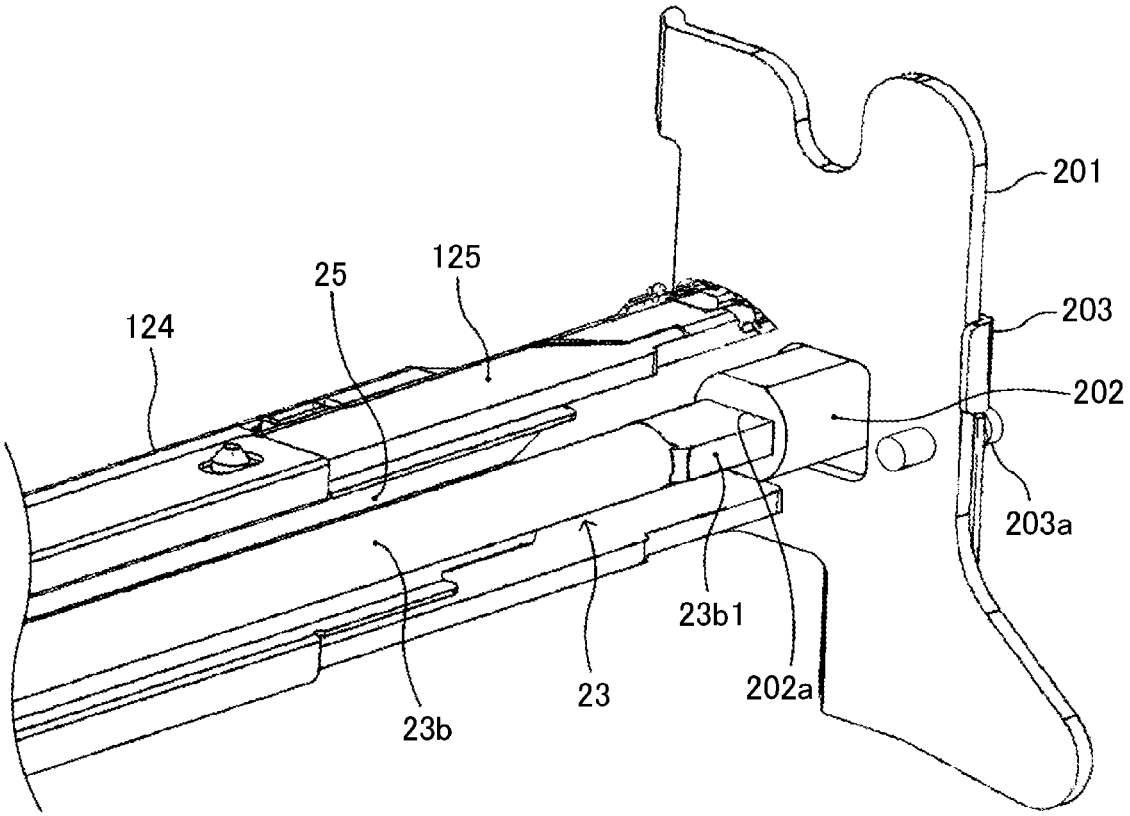
FIG. 4 is a perspective view illustrating a main part of an end portion of the fixing device in an axial direction.

FIG. 4 is a perspective view illustrating a main part of an end portion of the fixing device in the axial direction.

The halogen heater 23 has box-shaped fitting portions 23*b*1 on both axial end portions of the glass tube 23*b*. A part of the fitting portion 23*b*1 enters a fitting hole 202*a* of a heater support 202 as a heat source supporting member, and the heater support 202 supports the halogen heater 23. The heater support 202 is fixed to a bracket 203, and the bracket 203 is fixed to the side plate 201 of the fixing device 20 with a screw 203*a*.

Figure 5:
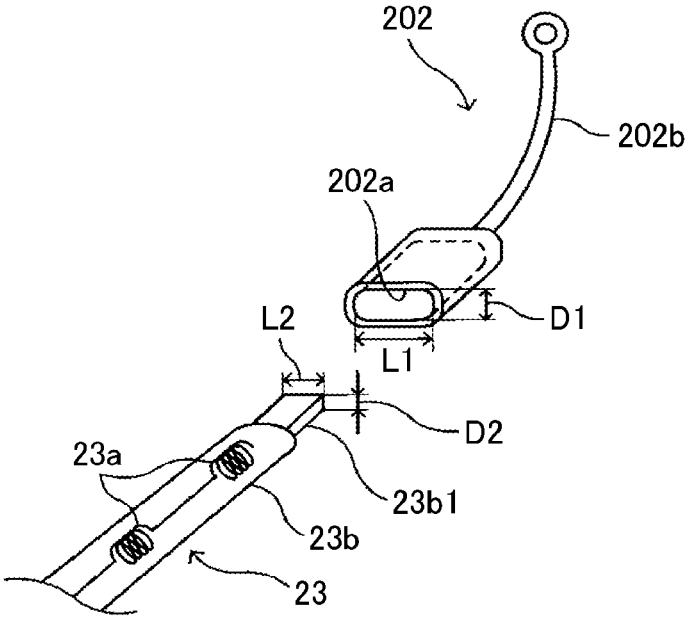
FIG. 5 is a schematic perspective view illustrating a heater support and a halogen heater.

FIG. 5 is a schematic perspective view illustrating the heater support 202 and the halogen heater 23.

As illustrated in FIG. 5, a length L2 of the fitting portion 23*b*1 in a transverse direction of the halogen heater 23 is smaller than a length L1 of the fitting hole 202*a* of the heater support 202 in the transverse direction, that is, L1>L2. In addition, a length D2 of the fitting portion 23*b*1 in a thickness direction is smaller than a length D1 of the fitting hole 202*a* in the thickness direction, that is, D1>D2. Due to the above-described dimensional relationship, the halogen heater 23 is supported by the heater support 202 by the clearance fit.

A lead wire 202*b* is attached to the heater support 202. The lead wire 202*b* electrically couples between the molybdenum foil 24*a* disposed in the sealing 24 of the halogen heater 23 (see FIG. 3) and a power supply that supplies power to the halogen heater 23.

In the present embodiment, a clearance between the fitting portion 23*b*1 and the fitting hole 202*a* in a clearance fit portion in which the halogen heater 23 is set to the heater support 202 is 0.1 mm or more and 0.7 mm or less, that is, 0.1 mm≤(L1−L2)≤0.7 mm and 0.1 mm≤(D1−D2)≤0.7 mm. As described below, the clearance between the fitting portion 23*b*1 and the fitting hole 202*a* exceeding 0.7 mm may cause a large inclination of the halogen heater 23 with respect to the axial direction. Under the large inclination, an amount of heat applied from the halogen heater 23 to the one end portion of the fixing belt 21 largely differs from an amount of heat applied from the halogen heater 23 to the other end portion of the fixing belt 21. As a result, even if the thermal equalizer 131 is provided or the fixing belt 21 is made of the material having high thermal conductivity, a temperature distribution of the fixing belt 21 in the axial direction of the fixing belt 21 may not be made uniform, and uneven gloss and a fixing failure may occur. On the other hand, the clearance between the fitting portion 23*b*1 and the fitting hole 202*a* being less than 0.1 mm may cause a case in which the fitting portion 23*b*1 does not enter the fitting hole 202*a* due to a manufacturing error, which reduces the yield of the fixing device 20. Additionally, the clearance between the fitting portion 23*b*1 and the fitting hole 202*a* being less than 0.1 mm deteriorates the assembly workability because the fitting portion 23*b*1 of the halogen heater 23 slightly inclined in the axial direction cannot be inserted into the fitting hole 202*a*.

In contrast, setting the clearance between the fitting portion 23*b*1 and the fitting hole 202*a* to be 0.1 mm or more and 0.7 mm or less can improve the assembly workability because the fitting portion 23*b*1 of the halogen heater 23 slightly inclined in the axial direction can be inserted into the fitting hole 202*a*. In addition, setting the clearance as described above can prevent a difference between the amount of heat applied from the halogen heater 23 to the one end portion of the fixing belt 21 and the amount of heat applied from the halogen heater 23 to the other end portion of the fixing belt 21 when the halogen heater 23 is inclined with respect to the axial direction from becoming too large. Therefore, using the thermal equalizer 131 and the fixing belt 21 having a high thermal conductivity enables the temperature distribution in the axial direction of the fixing belt 21 to be sufficiently uniform and can prevent the occurrence of uneven gloss and fixing failure.

When the halogen heater 23 is fixed to the heater support 202 with an adhesive, adhesion failure due to insufficient filling of cement (that is the adhesive) between the halogen heater 23 and the heater support 202 or adhesion of the cement to the halogen heater 23 occur at a certain rate, which reduces the yield. In addition, the moisture absorption of the cement may lower the electrical resistance of the cement and may cause a leak.

However, supporting the halogen heater 23 to the heater support 202 with the clearance fit as in the present embodiment prevents the adhesion failure and the adhesion of the cement (that is the adhesive) to the halogen heater 23 and can improve the yield. In addition, the present embodiment can prevent the occurrence of leak.

Figure 6A:
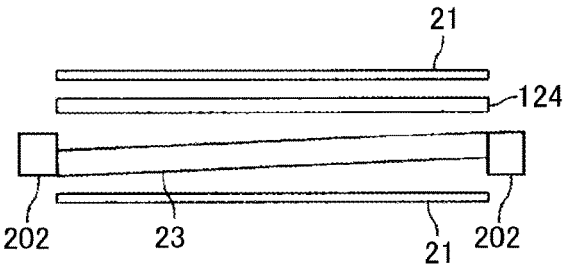
FIG. 6A is an explanatory view illustrating the fixing device including a fixing belt and the inclined halogen heater but not including a thermal equalizer.
Figure 6C:
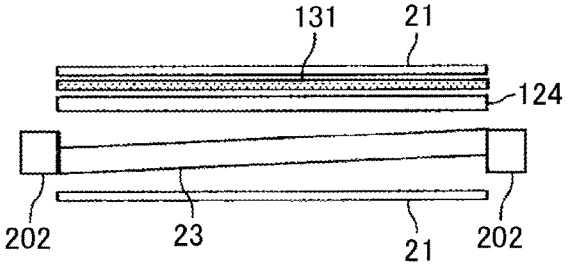
FIG. 6C is an explanatory view illustrating the fixing device including a fixing belt, the inclined halogen heater, and the thermal equalizer.
Figure 6B:
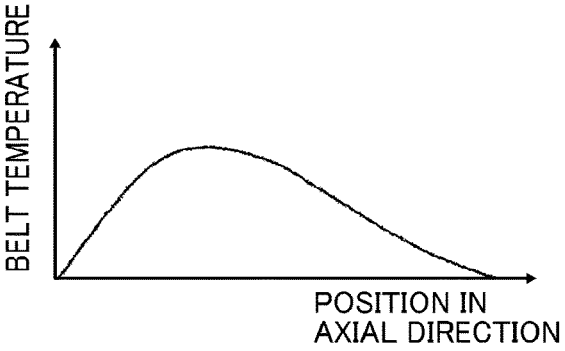
FIG. 6B is a graph illustrating a temperature distribution of the fixing belt in FIG. 6A in an axial direction of the fixing belt.
Figure 6D:
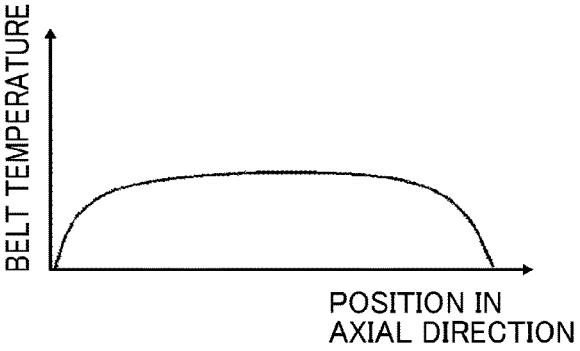
FIG. 6D is a graph illustrating a temperature distribution of the fixing belt in FIG. 6C in the axial direction of the fixing belt.

FIG. 6A is an explanatory view illustrating the fixing device 20 including the fixing belt 21 and the inclined halogen heater 23 but not including the thermal equalizer 131, FIG. 6B is a graph illustrating a temperature distribution of the fixing belt 21 in FIG. 6A in the axial direction of the fixing belt 21, FIG. 6C is an explanatory view illustrating the fixing device 20 including the fixing belt 21, the inclined halogen heater 23, and the thermal equalizer 131, and FIG. 6D is a graph illustrating a temperature distribution of the fixing belt 21 in FIG. 6C in the axial direction of the fixing belt 21.

The graphs in FIGS. 6B and 6D illustrate the temperature distributions of the fixing belt 21 when the clearance between the fitting portion 23*b*1 of the halogen heater 23 and the fitting hole 202*a* of the heater support 202 is 0.1 mm.

In the present embodiment, since the halogen heater 23 is set to the heater support 202 by the clearance fit to improve the yield as described above, the halogen heater 23 may be inclined in the axial direction (that is the longitudinal direction) as illustrated in FIGS. 6A and 6C. In addition, when the halogen heater 23 is turned on, the thermal expansion of the heater support 202 expands the clearance between the fitting portion 23*b*1 and the fitting hole 202*a* and may increase the inclination of the halogen heater 23 with respect to the axial direction (that is the longitudinal direction).

In FIGS. 6A and 6C, the direction perpendicular to the sheet surface in FIGS. 6A and 6C is a vertical direction of the fixing device 20 in the present embodiment, and the vertical direction in FIGS. 6A and 6C is a horizontal direction in the fixing device 20 in the present embodiment. When the halogen heater 23 is inclined as illustrated in FIGS. 6A and 6C, the attitude of the halogen heater 23 is maintained unless a horizontal impact is applied to the fixing device 20.

As illustrated in FIGS. 6A and 6C, when the halogen heater 23 is inclined with respect to the axial direction, a distance from the fixing belt 21 to one end (that is a left side in FIGS. 6A and 6C) of the halogen heater 23 in the axial direction is shorter than a distance from the fixing belt 21 to the other end (that is a right side in FIGS. 6A and 6C). As a result, an amount of heat applied from the halogen heater 23 to one end portion of the fixing belt 21 is larger than an amount of heat applied from the halogen heater 23 to the other end portion of the fixing belt 21. Therefore, as illustrated in FIG. 6B, in the fixing device 20 not including the thermal equalizer 131, a temperature of the fixing belt 21 at one end portion (that is a left side in FIG. 6B) is higher than a temperature of the fixing belt 21 at the other end portion (that is a right side in FIG. 6B), and a temperature distribution in the fixing belt 21 in the axial direction becomes non-uniform. The above-described non-uniform temperature distribution may cause uneven gloss of the fixed toner image on the recording medium, that is, the uneven gloss having different gloss values at one end portion and the other end portion in a width direction of the recording medium. In addition, the above-described configuration reduces an amount of heat that the other end portion of the fixing belt 21 applies to the toner image and may cause the fixing failure of the toner image on the other end portion of the fixing belt 21.

In contrast, in the fixing device 20 including the thermal equalizer 131 as illustrated in FIG. 6C, the thermal equalizer 131 transfers heat from one end portion (that is a left side in FIG. 6C) of the fixing belt 21 that stores a large amount of heat to the other end portion (that is a right side in FIG. 6C) of the fixing belt 21 having a little amount of heat. The above-described configuration can maintain a uniform temperature distribution of the fixing belt 21 in the axial direction thereof as illustrated in FIG. 6D even if the halogen heater 23 is inclined with respect to the axial direction as illustrated in FIG. 6C. Therefore, the occurrence of uneven gloss can be prevented. In addition, the above-described configuration can satisfactorily heat the toner image in the axial direction and does not cause the fixing failure of the toner image on the other end portion of the fixing belt 21.

In the present embodiment, the thermal equalizer 131 is disposed between the nip formation pad 124 and the fixing belt 21. Alternatively, the thermal equalizer 131 may be disposed on an upstream portion of the fixing belt 21 from the fixing nip N in a direction of movement of the fixing belt 21. In the above-described configuration, the thermal equalizer 131 also enables the temperature distribution in the axial direction of the fixing belt 21 to be uniform before the fixing belt 21 enters the fixing nip N and can prevent the occurrence of uneven gloss and fixing failure. However, disposing the thermal equalizer 131 between the nip formation pad 124 and the fixing belt 21 is preferable because an existing component such as the pressure roller 22 can press the fixing belt 21 against the thermal equalizer 131 so that the thermal equalizer 131 closely contact the fixing belt 21 without increasing the number of components, that is, increasing a production cost of the fixing device can be avoided.

An evaluation test was conducted to evaluate advantages of the present disclosure.

In the evaluation test, a plurality of fixing devices (No. 1 to No. 10) in Table 1 and Table 2 were made. These fixing devices had different clearances between the fitting portion 23*b*1 and the fitting hole 202*a*, and the fixing belts 21 were made of different materials as illustrated in Table 1. Some fixing devices did not include the thermal equalizer 131, and other fixing devices included the thermal equalizer 131 made of aluminum because of excellent workability and an inexpensive production cost. In Table 1, "Provided" means that the fixing devices include the thermal equalizer 131, and "No" means that the fixing devices do not include the thermal equalizer 131. The fixing device No. 2 includes the cement to fix the halogen heater to the heater support, which illustrates as "Applied" in Table 1, and other fixing devices No. 1 and No. 3 to No. 10 do not include the cement, which illustrates as "No" in Table 1. In the evaluation test, uneven gloss, an occurrence of the leak, assembly workability, assembly yield, and component yield were evaluated.

To evaluate the uneven gloss, the fixing devices No. 1 to No. 10 that were different in the clearances between the fitting portion 23*b*1 and the fitting hole 202*a*, the presence or absence of the thermal equalizer 131, and the material of the fixing belt 21 were made and set to the image forming apparatus 1 as illustrated in FIG. 1, and solid images were outputted to visually evaluate the uneven gloss. When the uneven gloss was not observed, the uneven gloss was evaluated as "Good". When the uneven gloss was observed but acceptable, the uneven gloss was evaluated as "Fair". When the uneven gloss was observed and not acceptable, the uneven gloss was evaluated as "Bad".

To evaluate the leak, the fixing devices No. 1 to No. 10 were placed for 4 weeks in an environment of a temperature of 40° C. and a humidity of 70% and set to the image forming apparatus 1 to print a predetermined image and visually observe the presence or absence of fixing failure. When the fixing failure was not observed, it was determined that the fixing failure due to the leak did not occur, and the evaluation result was "Good". When the fixing failure was observed, it was determined that the fixing failure due to the leak occurred, and the evaluation result was "Bad".

To evaluate the assembly workability, a working speed to assemble each of the fixing devices No. 1 to No. 10 was measured. When the working speed was equal to or faster than the working speed to assemble the fixing device No. 2, the assembly workability was evaluated as "Good". When the working speed was slower than the working speed to assemble the fixing device No. 2, the assembly workability was evaluated as "Bad".

The assembly yield was evaluated as "Good" when no defective products were produced during assembly of ten-thousand fixing devices having the same condition as each of the fixing devices No. 1 to No. 10, and, when the defective product was produced, the assembly yield was evaluated as "Bad".

To evaluate the component yield, ten-thousand halogen heaters 23 and ten-thousand heater supports 202 having the same condition as each of the fixing devices No. 1 to No. 10 are checked. The component yield was evaluated as "Good" when the dimensions of the fitting portions 23*b*1 and the fitting holes 202*a* were all within their tolerances. When at least one of the fitting portions 23*b*1 and the fitting holes 202*a* had a dimension out of tolerance, the component yield was evaluated as "Bad".

Table 2 represents the results of the evaluation test.

TABLE 1

| No. | Thermal Equalizer | Belt Material | Cement | Clearance (mm) Hole diameter - Shaft diameter |
|---|---|---|---|---|
| 1 | Not provided | Nickel | Not applied | 0.1 |
| 2 | Not provided | Nickel | Applied | 0.1 |
| 3 | Not provided | Nickel | Not applied | 0.05 |
| 4 | Provided | Nickel | Not applied | 0.05 |
| 5 | Provided | Nickel | Not applied | 0.1 |
| 6 | Provided | Nickel | Not applied | 0.5 |
| 7 | Provided | Nickel | Not applied | 0.7 |
| 8 | Provided | Nickel | Not applied | 0.9 |
| 9 | Provided | Copper | Not applied | 0.9 |
| 10 | Provided | Copper | Not applied | 1.2 |

TABLE 2

| No. | Uneven Gloss | Leak | Assembly Workability | Assembly Yield | Component Yield |
|---|---|---|---|---|---|
| 1 | Bad | Good | Good | Good | Good |
| 2 | Good | Bad | Good | Bad | Good |
| 3 | Fair | Good | Bad | Good | Bad |
| 4 | Good | Good | Bad | Good | Bad |
| 5 | Good | Good | Good | Good | Good |
| 6 | Good | Good | Good | Good | Good |
| 7 | Good | Good | Good | Good | Good |
| 8 | Bad | Good | Good | Good | Good |
| 9 | Good | Good | Good | Good | Good |
| 10 | Bad | Good | Good | Good | Good |

As illustrated in Table 2, the leak occurred in the fixing device No. 2 and was evaluated as "Bad" in the fixing device No. 2. In the fixing device No. 2, the halogen heater 23 is fixed to the heater support 202 with the cement. It is considered that the cement absorbed moisture and decreased an electrical resistance, and the leak occurred. In addition, the assembly yield in the fixing device No. 2 was evaluated as "Bad". This is because adhesion of cement to other parts and defective adhesion occurred at a constant rate during assembly.

In contrast, in the fixing devices NO. 1 and No. 3 to No. 10, just inserting the fitting portion 23*b*1 into the fitting hole 202*a* completed setting the halogen heater 23 in the heater support 202, not using the cement. Therefore, when the halogen heater 23 was set to the heater support 202, no defective product was produced, and the assembly yield was evaluated as "Good". The above-described result confirms that fitting the halogen heater 23 to the heater support 202 by the clearance fit improves the assembly yield, as compared with fixing by the cement. In addition, in the fixing device No. 1 and No. 3 to No. 10, the fixing failure due to the leak did not occur, which confirms fitting the halogen heater 23 to the heater support 202 by the clearance fit can also prevent the occurrence of the leak.

The fixing devices No. 3 and No. 4 had the clearance between the fitting portion 23*b*1 and the fitting hole 202*a* set to 0.05 mm corresponding to the fitting tolerance according to the tolerance zone class of JIS B0401, and the assembly workability and the component yield were evaluated as "Bad". This is because the clearance 0.05 mm between the fitting portion 23*b*1 and the fitting hole 202*a* is small as the dimensional tolerance, and the fitting portion 23*b*1 having the dimension out of the dimensional tolerance and the fitting hole 202*a* having the dimension out of the dimensional tolerance were produced at a certain rate. As a result, the component yield was evaluated as "Bad". In addition, since inserting the fitting portion 23*b*1 into the fitting hole 202*a* was difficult, the working speed to assemble the fixing devices No. 3 and No. 4 was slower than the working speed to assemble the fixing device No. 2, and the assembly workability was evaluated as "Bad".

In contrast, in the fixing devices No. 1 and No. 5 to No. 10 having the clearance between the fitting portion 23*b* and the fitting hole 202*a* set to 0.1 mm or more, the assembly workability and the component yield were evaluated as "Good". This is because the above-described clearance 0.1 mm or more allows increasing the dimensional tolerance of the fitting portion and the dimensional tolerance of the fitting hole, and all the fitting portions 23*b*1 and all the fitting holes 202*a* fall within the above dimensional tolerance. As a result, the component yield was evaluated as "Good". In addition, since inserting the fitting portion 23*b*1 into the fitting hole 202*a* was easy, the working speed to assemble the fixing devices No. 1 and No. 5 to No. 10 was faster than the working speed to assemble the fixing device No. 2, and the assembly workability was evaluated as "Good".

In the fixing device No. 1 not including the thermal equalizer 131, the uneven gloss was evaluated as "Bad". However, in the fixing device No. 5 including the thermal equalizer 131 and having the same condition as the fixing device No. 1 other than the thermal equalizer 131, the uneven gloss was evaluated as "Good". Additionally, in the fixing devices No. 6 and No. 7 having the clearance between the fitting portion 23*b*1 and the fitting hole 202*a* larger than the fixing device No. 5, the uneven gloss was evaluated as "Good". However, in the fixing device No. 8 having the clearance between the fitting portion 23*b*1 and the fitting hole 202*a* set to be 0.9 mm, the uneven gloss was evaluated as "Bad".

The above confirms that the fixing device having the clearance between the fitting portion 23*b*1 and the fitting hole 202*a* set to be 0.1 mm or more and 0.7 mm or less and including the thermal equalizer 131 can prevent the temperature of the fixing belt 21 from becoming greatly different in the axial direction and improve the uneven gloss to be equal to or better than the fixing device in which the halogen heater 23 is fixed to the heater support 202 with the cement.

In the fixing device No. 9 including the fixing belt 21 made of copper having a higher thermal conductivity than the thermal equalizer 131 made of aluminum, although the clearance between the fitting portion 23*b*1 and the fitting hole 202*a* was 0.9 mm, the uneven gloss was evaluated as "Good". As described above, using the fixing belt 21 having a high thermal conductivity can further prevent the temperature of the fixing belt 21 from being greatly different in the axial direction.

In the present embodiment, the halogen heater is used as the heater, but the heater to heat the fixing belt 21 is not limited to the halogen heater and may be, for example, a carbon heater or the like.

The embodiments described above are just examples, and the various aspects of the present disclosure attain respective effects as follows.

First Aspect

A fixing device such as the fixing device 20 according to a first aspect includes an endless first rotator such as the fixing belt 21, a second rotator such as the pressure roller 22 configured to contact and press the first rotator, a heater such as the halogen heater 23 configured to heat the first rotator, a heater support such as the heater support 202 configured to support the heater by a clearance fit, and a thermal equalizer such as the thermal equalizer 131 contacting the first rotator to uniform a temperature distribution in an axial direction of the first rotator.

The configuration in which the heater such as the halogen heater is fixed to the heater support by the adhesive may cause the adhesion failure and the adhesion of the adhesive to the heater portion of the heater and decrease the assembly yield as described above. There is room for improvement in assembly.

In contrast, in the fixing device according to the first aspect, the heater support supports the heater by the clearance fit. Since the above-described configuration does not use the adhesive, the adhesion failure and the adhesion of the adhesive to the heater of the heat source does not occur. Therefore, the assembly workability can be improved.

A variation in a distance between the first rotator and the heater supported by the clearance fit in the heater support in the axial direction of the first rotator may be larger than a variation in a distance between the first rotator and the heater fixed in the heater support. Therefore, the clearance fit may increase a variation in amounts of heat applied from the heater to the first rotator in the axial direction. However, the fixing device according to the first aspect includes the thermal equalizer that uniforms the temperature distribution of the first rotator in the axial direction. The above-described thermal equalizer transfers heat from a portion that stores a large amount of heat in the first rotator in the axial direction (that is, a high temperature portion) to the other portion having a little amount of heat in the first rotator (that is, a low temperature portion). Therefore, the fixing device according to the first aspect can decrease a variation in the temperature distribution of the first rotator in the axial direction even if amounts of heat applied from the heater to the first rotator in the axial direction fluctuate. As a result, good fixing property can be maintained.

Second Aspect

In addition to the fixing device such as the fixing device 20 according to the first aspect, the fixing device according to a second aspect includes a nip formation pad such as the nip formation pad 124 contacting the second rotator such as the pressure roller 22 via the first rotator such as the fixing belt 21 to form a fixing nip between the second rotator and the nip formation pad, and the thermal equalizer such as the thermal equalizer 131 is arranged between the nip formation pad and the first rotator.

According to the second aspect, as described in the embodiment, the existing component such as the pressure roller 22 can press the first rotator such as the fixing belt 21 against the thermal equalizer such as the thermal equalizer 131 so that the thermal equalizer closely contact the fixing belt 21 without increasing the number of components, which can prevent a production cost of the fixing device from increasing.

Third Aspect

The fixing device such as the fixing device 20 according to a third aspect includes a halogen heater such as the halogen heater 23 as the heater in the fixing device according to the first and second aspect.

According to the third aspect, the halogen heater such as the halogen heater 23 can be easily assembled to the heater support, and the temperature distribution in the axial direction of the first rotator such as the fixing belt 21 can be uniform.

Fourth Aspect

In the fixing device according to the first aspect to the third aspect, the fixing device such as the fixing device 20 according to a fourth aspect has a clearance between the heater support such as the heater support 202 and the heater such as the halogen heater 23 in the clearance fit portion that is equal to or longer than 0.1 mm and equal to or shorter than 0.7 mm.

As described in the evaluation test, the fourth aspect can improve the assembly workability and the component yield. In addition, the fourth aspect can reduce a difference between the temperature of the first rotator such as the fixing belt 21 at one end portion and the temperature of the first rotator at the other end portion and decrease the uneven gloss and the fixing failure of the toner image on the other end portion of the first rotator.

Fifth Aspect

In the fixing device according to any one of the first aspect to the fourth aspect, the fixing device such as the fixing device 20 according to a fifth aspect includes the first rotator such as the fixing belt 21 having a thermal conductivity higher than a thermal conductivity of the thermal equalizer such as the thermal equalizer 131.

As describe in the evaluation test, the fifth aspect can further reduce the difference between the temperature of the first rotator such as the fixing belt 21 at one end portion and the temperature of the first rotator at the other end portion and decrease the uneven gloss and the fixing failure of the toner image on the other end portion of the first rotator.

Sixth Aspect

An image forming apparatus in a sixth aspect includes the image forming section configured to form the image on the recording medium and the fixing device according to any one of the first aspect to the fifth aspect configured to fix the image formed on the recording medium onto the recording medium.

The sixth aspect can reduce the production cost and provide good images.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A fixing device, comprising:

an endless first rotator;

a second rotator configured to contact and press the first rotator;

a heater configured to heat the first rotator;

a heater support supporting the heater by a clearance fit, wherein the heater includes a fitting portion at an end portion of the glass tube that electrically and physically connects to the heater support at a fitting hole of the heater support, so that the heater support supports the heater and electrically connects the heater to a power supply when the fitting portion is fitted into the fitting hole, a cross section of the fitting hole being larger than a cross section of the fitting portion by at least a predetermined amount so as to define the clearance fit; and a thermal equalizer contacting the first rotator to make uniform a temperature distribution in an axial direction of the first rotator, wherein the heater support supports the heater by the clearance fit, and a clearance between the fitting hole and the fitting portion in a transverse direction is not smaller than 0.1 mm and not greater than 0.7 mm.

2. The fixing device according to claim 1, further comprising a nip formation pad pressing against the second rotator via the first rotator to form a fixing nip between the second rotator and the first rotator, wherein the thermal equalizer is arranged between the nip formation pad and the first rotator.

3. The fixing device according to claim 1, wherein the heater is a halogen heater.

4. The fixing device according to claim 1, wherein a thermal conductivity of the first rotator is higher than a thermal conductivity of the thermal equalizer.

5. An image forming apparatus comprising:

an image forming section configured to form an image on a recording medium, and the fixing device according to claim 1 configured to fix the image on the recording medium.

6. The fixing device of claim 1, wherein the heater support is connected to the heater without adhesive.

7. The fixing device of claim 1, wherein a clearance between the fitting hole and the fitting portion in a thickness direction is not smaller than 0.1 mm and not greater than 0.7 mm.

8. The fixing device of claim 5, wherein a clearance between the fitting hole and the fitting portion in a thickness direction is not smaller than 0.1 mm and not greater than 0.7 mm.

* * * * *